US008784954B2

(12) United States Patent
Nito et al.

(10) Patent No.: US 8,784,954 B2
(45) Date of Patent: Jul. 22, 2014

(54) RECORDING MEDIUM

(71) Applicant: Canon Kabushiki Kaisha, Tokyo (JP)

(72) Inventors: Yasuhiro Nito, Inagi (JP); Hisao Kamo, Ushiku (JP); Naoya Hatta, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/050,981

(22) Filed: Oct. 10, 2013

(65) Prior Publication Data

US 2014/0106092 A1 Apr. 17, 2014

(30) Foreign Application Priority Data

Oct. 11, 2012 (JP) ..... 2012-226148

(51) Int. Cl.

*B41M 5/40* (2006.01)
*B41M 5/50* (2006.01)
*B41M 5/52* (2006.01)

(52) U.S. Cl.

CPC ..... *B41M 5/502* (2013.01); *B41M 5/506* (2013.01); *B41M 5/5218* (2013.01); *B41M 5/5254* (2013.01); *B41M 5/52* (2013.01); *B41M 5/508* (2013.01)

USPC ..... 428/32.24; 428/32.25; 428/32.26; 428/32.28; 428/32.34; 428/32.38

(58) Field of Classification Search

CPC .... B41M 5/502; B41M 5/506; B41M 5/5218; B41M 5/5254; B41M 5/52; B41M 5/508

USPC ..... 428/32.24, 32.25, 32.26, 32.28, 32.34, 428/32.38

See application file for complete search history.

(56) References Cited

U.S. PATENT DOCUMENTS

| | | | | |
|---|---|---|---|---|
| 2003/0008113 | A1* | 1/2003 | Ohya et al. | 428/195 |
| 2006/0078694 | A1* | 4/2006 | Motoda et al. | 428/32.24 |
| 2011/0104411 | A1* | 5/2011 | Oguri et al. | 428/32.31 |
| 2011/0256324 | A1* | 10/2011 | Noguchi et al. | 428/32.24 |

FOREIGN PATENT DOCUMENTS

| | | | |
|---|---|---|---|
| JP | 7-232473 | A | 9/1995 |
| JP | 8-132731 | A | 5/1996 |
| JP | 9-66664 | A | 3/1997 |
| JP | 9-76628 | A | 3/1997 |
| JP | 2008-265110 | A | 11/2008 |

* cited by examiner

*Primary Examiner* — Betelhem Shewareged

(74) *Attorney, Agent, or Firm* — Canon U.S.A., Inc., IP Division

(57) ABSTRACT

A recording medium includes, in sequence, a support; a first ink-receiving layer including an inorganic particle, a water-soluble polymer having a hydroxyl group, a water-soluble polymer not having a hydroxyl group, and a boric acid compound; and a second ink-receiving layer including an inorganic particle, a water-soluble polymer having a hydroxyl group, and a boric acid compound. The second ink-receiving layer does not include the water-soluble polymer not having the hydroxyl group, or the second ink-receiving layer includes the water-soluble polymer not having the hydroxyl group but the content of the water-soluble polymer not having the hydroxyl group relative to that of the inorganic particle in the second ink-receiving layer is smaller than the content of the water-soluble polymer not having the hydroxyl group relative to that of the inorganic particle in the first ink-receiving layer.

8 Claims, 1 Drawing Sheet

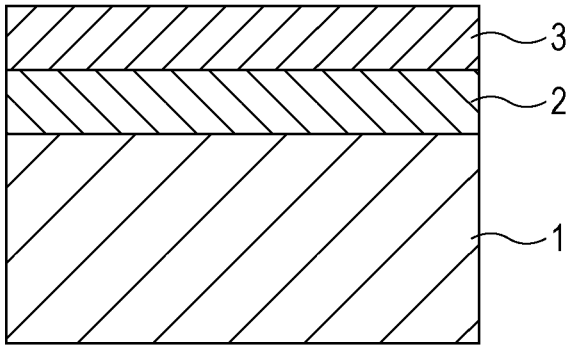
3
2
1

RECORDING MEDIUM

BACKGROUND OF THE INVENTION

1. Field of the Invention

The present invention relates to a recording medium.

2. Description of the Related Art

In recent years, the demand for an ink-jet recording method in the field of commercial printing has been increasing. Commercial printing requires not only properties that are required for a recording medium used in an ink-jet recording method, for example, a high optical density of an image obtained and a high storage stability in a high humidity environment, that is, a high moisture resistance but also a high ink-absorbing property for achieving high-speed recording and a property that scratches are not easily formed on a surface of a recording medium by a conveying roller when the recording medium is conveyed at a high speed, that is, a high conveyance scratch resistance.

As described above, various properties are desired for commercial printing. In particular, as a method for obtaining a high ink-absorbing property for achieving high-speed recording, a recording medium including a support and two ink-receiving layers disposed on the support is known. Japanese Patent Laid-Open No. 2008-265110 describes such a recording medium in which, in an ink-receiving layer disposed closer to a support, the content of a binder is 7% by mass or more and 12% by mass or less relative to the content of hydrated alumina serving as inorganic particles, and, in another ink-receiving layer disposed further away from the support, the content of a binder is 4% by mass or more and 6% by mass or less relative to the content of hydrated alumina.

SUMMARY OF THE INVENTION

However, as a result of studies conducted by the inventors of the present invention, it was found that the recording medium described in Japanese Patent Laid-Open No. 2008-265110 does not have a sufficient conveyance scratch resistance.

The present invention provides a recording medium in which an optical density and moisture resistance of an image obtained are high and which has a high ink-absorbing property and a good conveyance scratch resistance.

A recording medium according to an aspect of the present invention includes a support, a first ink-receiving layer, and a second ink-receiving layer in that order. In the recording medium, the first ink-receiving layer includes an inorganic particle, a water-soluble polymer having a hydroxyl group, a water-soluble polymer not having a hydroxyl group, and a boric acid compound. The second ink-receiving layer includes an inorganic particle, a water-soluble polymer having a hydroxyl group, and a boric acid compound, and satisfies a condition (1) "the second ink-receiving layer does not include the water-soluble polymer not having the hydroxyl group" or a condition (2) "the second ink-receiving layer includes the water-soluble polymer not having the hydroxyl group, but the content of the water-soluble polymer not having the hydroxyl group relative to the content of the inorganic particle in the second ink-receiving layer is smaller than the content of the water-soluble polymer not having the hydroxyl group relative to the content of the inorganic particle in the first ink-receiving layer".

According to the aspect of the present invention, it is possible to provide a recording medium in which an optical density and moisture resistance of an image obtained are high and which has a high ink-absorbing property and a good conveyance scratch resistance.

Further features of the present invention will become apparent from the following description of exemplary embodiments with reference to the attached drawing.

BRIEF DESCRIPTION OF THE DRAWING

The FIGURE is a schematic cross-sectional view of a recording medium illustrating an example of a layer structure according to the present invention.

DESCRIPTION OF THE EMBODIMENTS

The present invention will now be described in detail using embodiments.

As a result of various studies conducted by the inventors of the present invention, it was found that the advantage of the present invention can be achieved by the feature of the present invention. That is, at least two ink-receiving layers are provided on a support, a first ink-receiving layer disposed closer to the support includes, as a binder, both a water-soluble polymer having a hydroxyl group and a water-soluble polymer not having a hydroxyl group, and a second ink-receiving layer disposed further away from the support includes, as a binder, a water-soluble polymer having a hydroxyl group and satisfies a condition (1): "the second ink-receiving layer does not include the water-soluble polymer not having the hydroxyl group" or a condition (2): "the second ink-receiving layer includes the water-soluble polymer not having the hydroxyl group, but the content of the water-soluble polymer not having the hydroxyl group relative to the content of an inorganic particle in the second ink-receiving layer is smaller than the content of the water-soluble polymer not having the hydroxyl group relative to the content of an inorganic particle in the first ink-receiving layer". This mechanism is not clear, but the water-soluble polymer having the hydroxyl group in the ink-receiving layers reacts with the boric acid compound and is cross-linked, whereas the water-soluble polymer not having the hydroxyl group does not react with the boric acid compound and is not cross-linked. Accordingly, it was found that it is important that the amount of cross-linked site in the first ink-receiving layer be smaller than that in the second ink-receiving layer.

Recording Medium

A recording medium of the present invention includes a support, a first ink-receiving layer, and a second ink-receiving layer in that order. An example of a layer structure of the present invention will be described with reference to the FIGURE. A recording medium illustrated in the FIGURE includes a support 1, a first ink-receiving layer 2, and a second ink-receiving layer 3. Another layer may be further provided between the support 1 and the first ink-receiving layer 2, between the first ink-receiving layer 2 and the second ink-receiving layer 3, or on the second ink-receiving layer 3 as long as the advantage of the present invention is not impaired. In the present invention, the support 1, the first ink-receiving layer 2, and the second ink-receiving layer 3 may be disposed in that order so as to be adjacent to each other. In the present invention, the recording medium may be an ink-jet recording medium used in an ink-jet recording method. Components constituting the recording medium of the present invention will be described below.

<Support>

Examples of the support include a support including only base paper and a support including base paper and a polymer layer, that is, base paper coated with a polymer. In the present invention, a support including base paper and a polymer layer is preferably used. In such a case, the polymer layer may be provided only on one surface of the base paper, but the polymer layer is preferably provided on both surfaces of the base paper.

The base paper is produced by using wood pulp as a main raw material and optionally adding synthetic pulp composed of polypropylene or the like or synthetic fiber composed of nylon, polyester, or the like to make paper. Examples of the wood pulp include laubholz bleached kraft pulp (LBKP), laubholz bleached sulfite pulp (LBSP), nadelholz bleached kraft pulp (NBKP), nadelholz bleached sulfite pulp (NBSP), laubholz dissolving pulp (LDP), nadelholz dissolving pulp (NDP), laubholz unbleached kraft pulp (LUKP), and nadelholz unbleached kraft pulp (NUKP). These may be used alone or in combination of two or more thereof, as required. Among these various types of wood pulp, LBKP, NBSP, LBSP, NDP, and LDP, all of which have a high content of a short fiber component, are preferably used. The pulp is preferably chemical pulp (sulfate pulp or sulfite pulp) that has a low impurity content. Pulp subjected to a bleaching treatment to improve the degree of whiteness is also preferable. A sizing agent, a white pigment, a paper-strengthening agent, a fluorescent brightening agent, a water-retaining agent, a dispersant, a softening agent, and the like may be added to the base paper, as required.

In the present invention, a paper density of the base paper specified in JIS P 8118 is preferably 0.6 g/cm$^3$ or more and 1.2 g/cm$^3$ or less. Furthermore, the paper density is more preferably 0.7 g/cm$^3$ or more and 1.2 g/cm$^3$ or less.

In the present invention, when the support includes a polymer layer, the thickness of the polymer layer is preferably 20 μm or more and 60 μm or less. In the present invention, the thickness of the polymer layer is calculated by the following method. First, a cross section of a recording medium is cut with a microtome, and the cross section is observed with a scanning electron microscope. Next, the thicknesses at arbitrary 100 points or more of the polymer layer are measured, and the average thereof is defined as the thickness of the polymer layer. Thicknesses of other layers in the present invention are also calculated by the same method.

In the case where a polymer layer is provided on both surfaces of the base paper, each of the thicknesses of the polymer layers on the two surfaces preferably satisfies the above range. A thermoplastic polymer is preferably used as the polymer in the polymer layer. Examples of the thermoplastic polymer include acrylic polymers, acrylic silicone polymers, polyolefin polymers, and styrene-butadiene copolymers. Among these polymers, polyolefin polymers are preferably used. In the present invention, the term "polyolefin polymer" refers to a polymer obtained by using an olefin as a monomer. Specific examples thereof include homopolymers of ethylene, propylene, isobutylene, or the like and copolymers thereof. These polyolefin polymers may be used alone or in combination of two or more polymers, as required. Among these, polyethylene is preferably used. Low-density polyethylene (LDPE) and high-density polyethylene (HDPE) are preferably used as polyethylene. The polymer layer may contain a white pigment, a fluorescent brightening agent, an ultramarine blue pigment, etc. in order to adjust opacity, the degree of whiteness, and hue. Among these, a white pigment is preferably incorporated because opacity can be improved. Examples of the white pigment include rutile-type titanium dioxide and anatase-type titanium dioxide.

<Ink-Receiving Layer>

In the present invention, ink-receiving layers may be provided only on one surface of the support or on both surfaces of the support. The total thickness of all the ink-receiving layers provided on one surface of the support is preferably 30 μm or more and 45 μm or less.

In the present invention, the ink-receiving layers include at least two layers, namely, a first ink-receiving layer and a second ink-receiving layer. Materials that can be incorporated in each of the ink-receiving layers will now be described.

(First Ink-Receiving Layer)

In the present invention, the first ink-receiving layer includes an inorganic particle, a water-soluble polymer having a hydroxyl group and a water-soluble polymer not having a hydroxyl group, the polymers functioning as a binder, and a boric acid compound functioning as a cross-linking agent. The first ink-receiving layer preferably has a thickness of 15 μm or more and 30 μm or less.

(1) Inorganic Particle

An average primary particle size of inorganic particles is preferably 50 nm or less, more preferably 1 nm or more and 30 nm or less, and particularly preferably 3 nm or more and 10 nm or less. In the present invention, the average primary particle size of inorganic particles is a number-average particle size of the diameters of circles having the areas equal to the projected areas of primary particles of the inorganic particles when the inorganic particles are observed with an electron microscope. In this case, the measurement is conducted at at least 100 points or more.

In the present invention, the inorganic particles may be used in an ink-receiving layer coating liquid in a state where the inorganic particles are dispersed with a dispersant. An average secondary particle size of the inorganic particles in the dispersed state is preferably 0.1 nm or more and 500 nm or less, more preferably 1 nm or more and 300 nm or less, and particularly preferably 10 nm or more and 250 nm or less. The average secondary particle size of the inorganic particles in the dispersed state can be measured by a dynamic light scattering method.

In the present invention, the content (% by mass) of the inorganic particle in the first ink-receiving layer is preferably 30% by mass or more and 98% by mass or less, and more preferably 70% by mass or more and 96% by mass or less.

In the present invention, the amount (g/m$^2$) of inorganic particle applied when the first ink-receiving layer is formed is preferably 15 g/m$^2$ or more and 45 g/m$^2$ or less. When the amount of inorganic particle is in the above range, the first ink-receiving layer can easily have a preferred thickness.

Examples of the inorganic particle used in the present invention include particles composed of hydrated alumina, alumina, silica, colloidal silica, titanium dioxide, zeolite, kaolin, talc, hydrotalcite, zinc oxide, zinc hydroxide, aluminum silicate, calcium silicate, magnesium silicate, zirconium oxide, and zirconium hydroxide. These inorganic particles may be used alone or in combination of two or more inorganic particles, as required. Among the above inorganic particles, hydrated alumina, alumina, and silica, all of which can form a porous structure exhibiting a high ink-absorbing property, are preferably used.

Hydrated alumina that can be suitably used in the ink-receiving layer is one represented by general formula (X):

$$Al_2O_{3-n}(OH)_{2n}.mH_2O \qquad \text{General formula (X)}$$

(where n represents 0, 1, 2, or 3, m is 0 or more and 10 or less, preferably 0 or more and 5 or less, however, m and n are not zero at the same time.) Note that m may not represent an integer because, in many cases, $mH_2O$ represents an eliminable aqueous phase that does not participate in the formation of a crystal lattice. In addition, m can reach zero when the hydrated alumina is heated.

In the present invention, hydrated alumina can be produced by a known method. Specifically, examples thereof include a method in which an aluminum alkoxide is hydrolyzed, a method in which sodium aluminate is hydrolyzed, and a method in which an aqueous solution of sodium aluminate is neutralized by adding an aqueous solution of aluminum sulfate or aluminum chloride thereto.

Known crystal structures of hydrated alumina include amorphous, gibbsite, and boehmite in accordance with a heat-treatment temperature. The crystal structures of hydrated alumina can be analyzed by X-ray diffractometry. In the present invention, among these, hydrated alumina having a boehmite structure or amorphous hydrated alumina is preferable. Specific examples thereof include hydrated alumina described in, for example, Japanese Patent Laid-Open Nos. 7-232473, 8-132731, 9-66664, and 9-76628. Examples of commercially available hydrated alumina include DISPERAL HP14 and HP18 (both of which are manufactured by Sasol). These may be used alone or in combination of two or more thereof, as required.

In the present invention, hydrated alumina has a specific surface area of preferably 100 $m^2/g$ or more and 200 $m^2/g$ or less, and more preferably 125 $m^2/g$ or more and 190 $m^2/g$ or less, the specific surface area being determined by a BET method. The BET method is a method in which a molecule or an ion having a known size is allowed to be adsorbed on a surface of a sample, and the specific surface area of the sample is measured on the basis of the amount of adsorption. In the present invention, nitrogen gas is used as a gas that is allowed to be adsorbed on a sample.

Hydrated alumina preferably has a plate-like shape. Furthermore, an average aspect ratio which is a ratio of an average primary particle size of a flat-plate surface of hydrated alumina to an average particle thickness of the hydrated alumina is preferably 3.0 or more and 10 or less. The average particle thickness is determined as follows. Hydrated alumina particles are observed with an electron microscope, and arbitrary 10 hydrated alumina particles are selected. The average particle thickness is calculated from the number average of the thicknesses of the 10 hydrated alumina particles. In addition, a ratio of the minimum particle size of the flat-plate surface to the maximum particle size of the flat-plate surface is preferably 0.60 or more and 1.0 or less.

Vapor-phase process alumina is preferably used as alumina in the ink-receiving layer. Examples of such vapor-phase process alumina include γ-alumina, α-alumina, δ-alumina, θ-alumina, and χ-alumina. Among these, from the standpoint of the optical density of an image and the ink-absorbing property, γ-alumina is preferably used. Specific examples of vapor-phase process alumina include AEROXIDE Alu C, Alu 130, and Alu 65 (all of which are manufactured by EVONIK Industries).

In the present invention, the specific surface area of vapor-phase process alumina determined by the BET method is preferably 50 $m^2/g$ or more, and more preferably 80 $m^2/g$ or more. The specific surface area of vapor-phase process alumina is preferably 150 $m^2/g$ or less, and more preferably 120 $m^2/g$ or less.

The average primary particle size of vapor-phase process alumina is preferably 5 nm or more, and more preferably 11 nm or more. The average primary particle size of vapor-phase process alumina is preferably 30 nm or less, and more preferably 15 nm or less.

Hydrated alumina and alumina used in the present invention may be mixed in an ink-receiving layer coating liquid in the form of an aqueous dispersion liquid. An acid may be used as a dispersant for the aqueous dispersion liquid. A sulfonic acid represented by general formula (Y) is preferably used as the acid because an effect of suppressing bleeding of an image can be obtained:

$$R—SO_3H \qquad \text{General formula (Y)}$$

(where R represents any one of a hydrogen atom, an alkyl group having 1 to 4 carbon atoms, or an alkenyl group having 1 to 4 carbon atoms, and R may be substituted with an oxo group, a halogen atom, an alkoxy group, or an acyl group.) In the present invention, the content of the acid is preferably 1.0% by mass or more and 2.0% by mass or less, and more preferably 1.3% by mass or more and 1.6% by mass or less relative to the total content of hydrated alumina and alumina.

Silica used in the ink-receiving layer is broadly divided into two types of silica, namely, silica obtained by a wet process and silica obtained by a dry process (vapor-phase process) in terms of production process thereof. A known wet process is a method in which active silica is produced by acid decomposition of a silicate, the active silica is moderately polymerized to coagulate and sediment the polymerized product to obtain hydrous silica. Examples of a known dry process (vapor-phase process) include a method for obtaining anhydrous silica by a method (flame hydrolysis) in which a silicon halide is hydrolyzed in a vapor phase at a high temperature or a method (arc process) in which quartz sand and coke are heated, reduced, and gasified by arc in an electric furnace, and the resulting gas is oxidized with air. In the present invention, silica obtained by the dry process (vapor-phase process) (hereinafter also referred to as "vapor-phase-process silica") is preferably used. The reason for this is as follows. Vapor-phase-process silica has a particularly large specific surface area and thus has a particularly high ink-absorbing property. In addition, vapor-phase-process silica has a low refractive index and thus can impart transparency to the ink-receiving layer, thereby obtaining good color developability. Specific examples of vapor-phase-process silica include AEROSIL (manufactured by Nippon Aerosil Co., Ltd.) and Reolosil QS series (manufactured by TOKUYAMA Corporation).

In the present invention, the specific surface area of vapor-phase-process silica determined by the BET method is preferably 50 $m^2/g$ or more and 400 $m^2/g$ or less, and more preferably 200 $m^2/g$ or more and 350 $m^2/g$ or less.

In the present invention, vapor-phase-process silica may be used in an ink-receiving layer coating liquid in a state where particles of vapor-phase-process silica are dispersed with a dispersant. Vapor-phase-process silica in the dispersed state more preferably has an average secondary particle size of 50 nm or more and 300 nm or less. The average secondary particle size of vapor-phase-process silica in the dispersed state can be measured by a dynamic light scattering method.

In the present invention, hydrated alumina, alumina, and silica may be used as a mixture. Specifically, a method may be employed in which at least two selected from hydrated alumina, alumina, and silica are mixed and dispersed in the form of a powder to prepare a dispersion liquid.

(2) Binder

In the present invention, the first ink-receiving layer includes, as a binder, both a water-soluble polymer having a hydroxyl group and a water-soluble polymer not having a hydroxyl group. Note that, in the present invention, the term "water-soluble polymer" refers to a polymer having a solubility in water at a temperature of 25° C. of 5% by mass or more.

In the present invention, a mass ratio of the total content of the binder to the content of the inorganic particle in the first ink-receiving layer is preferably 10% by mass or more and 19% by mass or less.

In the present invention, the water-soluble polymer having the hydroxyl group preferably has a hydroxyl value of 500 mgKOH/g or more. The water-soluble polymer having the hydroxyl group preferably has a hydroxyl value of 1,300 mgKOH/g or less. Furthermore, the water-soluble polymer having the hydroxyl group more preferably has a hydroxyl value of 600 mgKOH/g or more and 1,000 mgKOH/g or less. Note that the term "hydroxyl value of a polymer" refers to the amount (mg) of potassium hydroxide necessary for acetylating hydroxyl groups contained in 1 g of the polymer. The hydroxyl value is measured by the method described in JIS K 1557.

In the present invention, the water-soluble polymer having the hydroxyl group has a weight-average molecular weight of preferably 10,000 or more and 1,000,000 or less, and more preferably 100,000 or more and 500,000 or less, the weight-average molecular weight being determined by gel permeation chromatography (GPC) in terms of polystyrene.

A mass ratio of the content of the water-soluble polymer having the hydroxyl group to the content of the inorganic particle in the first ink-receiving layer is preferably 5.0% by mass or more and 17.0% by mass or less, and more preferably 10.0% by mass or more and 15.0% by mass or less.

Examples of the water-soluble polymer having the hydroxyl group include polyvinyl alcohol, polyvinyl alcohol derivatives, poly(α-hydroxyacrylic acid), and poly(2-hydroxyethyl acrylate). These water-soluble polymers having the hydroxyl group may be used alone or in combination of two or more polymers, as required. Among these polymers, polyvinyl alcohol and polyvinyl alcohol derivatives are preferably used. Examples of the polyvinyl alcohol derivatives include cation-modified polyvinyl alcohol, anion-modified polyvinyl alcohol, silanol-modified polyvinyl alcohol, and polyvinyl acetal. Among these, in particular, polyvinyl acetal is more preferably used.

Polyvinyl alcohol can be synthesized by, for example, saponifying polyvinyl acetate. The degree of saponification of polyvinyl alcohol is preferably 80% by mole or more and 100% by mole or less, and more preferably 85% by mole or more and 98% by mole or less. Note that the term "degree of saponification" refers to a ratio of the number of moles of hydroxyl group produced by a saponification reaction when polyvinyl alcohol is obtained by saponifying polyvinyl acetate. In the present invention, a value measured in accordance with the method described in JIS-K6726 is used as the degree of saponification. An average degree of polymerization of polyvinyl alcohol is preferably 1,500 or more, and more preferably 2,000 or more and 5,000 or less. A viscosity-average degree of polymerization determined in accordance with the method described in JIS-K6726 is used as the average degree of polymerization of polyvinyl alcohol.

In the present invention, the term "water-soluble polymer not having the hydroxyl group" refers to a water-soluble polymer that substantially does not have a hydroxyl group. Specifically, the water-soluble polymer not having the hydroxyl group preferably has a hydroxyl value of 50 mgKOH/g or less.

In the present invention, the water-soluble polymer not having the hydroxyl group has a weight-average molecular weight of preferably 50,000 or more and 1,000,000 or less, and more preferably 100,000 or more and 500,000 or less, the weight-average molecular weight being determined by GPC in terms of polystyrene.

In the present invention, the water-soluble polymer not having the hydroxyl group preferably has a high glass transition temperature because the conveyance scratch resistance becomes high. The glass transition temperature of the water-soluble polymer not having the hydroxyl group is preferably 40° C. or higher and 200° C. or lower, and more preferably 90° C. or higher and 200° C. or lower.

A mass ratio of the content of the water-soluble polymer not having the hydroxyl group to the content of the inorganic particle in the first ink-receiving layer is preferably 1.0% by mass or more and 15.0% by mass or less, and more preferably 1.0% by mass or more and 10.0% by mass or less.

Specific examples of the water-soluble polymer not having the hydroxyl group include polyvinylpyrrolidone, polyacrylic acid, polymethacrylic acid, polyethylene oxide, polyacrylamide, and derivatives thereof. These water-soluble polymers not having the hydroxyl group may be used alone or in combination of two or more polymers, as required.

In the present invention, the content (% by mass) of the water-soluble polymer not having the hydroxyl group in the first ink-receiving layer is preferably 0.1 times or more and 3.0 times or less, and more preferably, 0.3 times or more and 2.0 times or less the content (% by mass) of the water-soluble polymer having the hydroxyl group in terms of mass ratio.

The first ink-receiving layer may include a binder other than the water-soluble polymer having the hydroxyl group and the water-soluble polymer not having the hydroxyl group as long as the advantage of the present invention is not impaired. Examples of the other binder include starch derivatives such as oxidized starch, etherified starch, and phosphoric acid-esterified starch; cellulose derivatives such as carboxymethyl cellulose and hydroxyethyl cellulose; and synthetic polymers such as polyurethane polymers, unsaturated polyester polymers, vinyl chloride-vinyl acetate copolymers, polyvinyl butyral, and alkyd polymers. These other binders may be used alone or in combination of two or more binders, as required.

(3) Cross-linking Agent

In the present invention, the first ink-receiving layer includes a boric acid compound as a cross-linking agent. Note that, in the present invention, the term "boric acid compound" also covers a borate.

Examples of the boric acid compound include orthoboric acid ($H_3BO_3$), metaboric acid, and diboric acid. The borate may be a water-soluble salt of the boric acid compound. Examples thereof include alkali metal salts of a boric acid compound such as a sodium salt of a boric acid compound and a potassium salt of a boric acid compound; alkaline earth metal salts of a boric acid compound such as a magnesium salt of a boric acid compound and a calcium salt of a boric acid compound; and ammonium salts of a boric acid compound. Among these, orthoboric acid is preferably used from the standpoint of the stability of the coating liquid with time, and an effect of suppressing the generation of cracks.

The amount of the boric acid compound used can be appropriately adjusted in accordance with the production conditions etc. In the present invention, a mass ratio of the content of the boric acid compound to the content of the water-soluble polymer having the hydroxyl group in the first ink-receiving layer is preferably 5% by mass or more and 50% by mass or less, and more preferably 20% by mass or more and 30% by mass or less.

A mass ratio of the content of the boric acid compound to the content of the inorganic particle in the first ink-receiving layer is preferably 1.5% by mass or more and 2.5% by mass or less, and more preferably 2.0% by mass or more and 2.5% by mass or less.

(4) Other Additives

In the present invention, the first ink-receiving layer may include additives other than the components described above. Specific examples of the additives include a pH adjustor, a thickener, a fluidity improver, an antifoaming agent, a foam inhibitor, a surfactant, a release agent, a penetrant, a color pigment, a color dye, a fluorescent brightening agent, an ultraviolet absorber, an antioxidant, an antiseptic agent, an antifungal agent, a waterproofing agent, a dye fixing agent, a curing agent, and a weather resistant material.

(Second Ink-receiving Layer)

In the present invention, the second ink-receiving layer includes an inorganic particle, a water-soluble polymer having a hydroxyl group and functioning as a binder, and a boric acid compound functioning as a cross-linking agent. Furthermore, the second ink-receiving layer satisfies a condition (1): "the second ink-receiving layer does not include the water-soluble polymer not having the hydroxyl group" or a condition (2): "the second ink-receiving layer includes the water-soluble polymer not having the hydroxyl group, but the content of the water-soluble polymer not having the hydroxyl group relative to the content of the inorganic particle in the second ink-receiving layer is smaller than the content of the water-soluble polymer not having the hydroxyl group relative to the content of the inorganic particle in the first ink-receiving layer". The second ink-receiving layer preferably has a thickness of 5 μm or more and 15 μm or less.

(1) Inorganic Particle

As the inorganic particle of the second ink-receiving layer, it is possible to use inorganic particles the same as those exemplified as inorganic particles that can be used in the first ink-receiving layer.

In the present invention, the content (% by mass) of the inorganic particle in the second ink-receiving layer is preferably 30% by mass or more and 98% by mass or less, and more preferably 70% by mass or more and 96% by mass or less.

In the present invention, the amount ($g/m^2$) of inorganic particle applied when the second ink-receiving layer is formed is preferably 3 $g/m^2$ or more and 15 $g/m^2$ or less. When the amount of inorganic particle is in the above range, the second ink-receiving layer can easily have a preferred thickness.

(2) Binder

In the present invention, the second ink-receiving layer includes a water-soluble polymer having a hydroxyl group as a binder. As the water-soluble polymer having the hydroxyl group used in the second ink-receiving layer, it is possible to use polymers the same as those exemplified as a binder that can be used in the first ink-receiving layer.

A mass ratio of the content of the water-soluble polymer having the hydroxyl group to the content of the inorganic particle in the second ink-receiving layer is preferably 7.0% by mass or more and 15.0% by mass or less, and more preferably 8.5% by mass or more and 12.0% by mass or less.

A mass ratio of the content of the water-soluble polymer not having the hydroxyl group to the content of the inorganic particle in the second ink-receiving layer is preferably less than 5.0% by mass, more preferably less than 3.0% by mass, and particularly preferably 0% by mass, that is, satisfies the condition (1): "the second ink-receiving layer does not include the water-soluble polymer not having the hydroxyl group".

In addition, the content of the water-soluble polymer not having the hydroxyl group relative to the content of the inorganic particle in the second ink-receiving layer is preferably 20% by mass or less relative to the content of the water-soluble polymer not having the hydroxyl group relative to the content of the inorganic particle in the first ink-receiving layer. Furthermore, a value represented by (the content of the water-soluble polymer not having the hydroxyl group relative to the content of the inorganic particle in the first ink-receiving layer)−(the content of the water-soluble polymer not having the hydroxyl group relative to the content of the inorganic particle in the second ink-receiving layer) is preferably 5% mass or more, and more preferably 10% by mass or more.

The second ink-receiving layer may include a binder other than the water-soluble polymer having the hydroxyl group as long as the advantage of the present invention is not impaired. As the other binder, it is possible to use polymers the same as those exemplified as a binder that can be used in the first ink-receiving layer.

(3) Cross-linking Agent

In the present invention, the second ink-receiving layer includes the boric acid compound as a cross-linking agent. As the boric acid compound used in the second ink-receiving layer, it is possible to use the boric acid compound the same as those exemplified as the boric acid compound that can be used in the first ink-receiving layer.

The amount of the boric acid compound used can be appropriately adjusted in accordance with the production conditions etc. In the present invention, a mass ratio of the content of the boric acid compound to the content of the water-soluble polymer having the hydroxyl group in the second ink-receiving layer is preferably 5% by mass or more and 20% by mass or less, and more preferably 5% by mass or more and 15% by mass or less.

A mass ratio of the content of the boric acid compound to the content of the inorganic particle in the second ink-receiving layer is preferably 1.0 by mass or more and 2.0% by mass or less.

(4) Other Additives

In the present invention, the second ink-receiving layer may include additives other than the components described above. Specifically, it is possible to use additives the same as those exemplified as the other additives that can be used in the first ink-receiving layer.

Method for Producing Recording Medium

In the present invention, a method for producing a recording medium is not particularly limited. The method for producing a recording medium may include a step of preparing an ink-receiving layer coating liquid, and a step of applying the ink-receiving layer coating liquid onto a support. A method for producing a recording medium will be described below.

<Method for Preparing Support>

In the present invention, a commonly used method for making paper can be used as a method for preparing base paper. Examples of a paper machine include a Fourdrinier machine, a cylinder machine, a drum machine, and a twin-wire machine. In order to increase the surface smoothness of base paper, a surface treatment may be performed by applying heat and a pressure during or after a papermaking process. Specific examples of the surface treatment method include a calender treatment such as machine calendering and super calendering.

In the case where the support includes a polymer layer, examples of a method for providing a polymer layer on base paper, that is, a method for coating base paper with a polymer, include a melt extrusion method, a wet lamination method, and a dry lamination method. Among these methods, a melt extrusion method is preferable in which a molten polymer is extruded on a surface or both surfaces of base paper to coat the base paper with the polymer. An example of a widely used method is a method (also referred to as an "extrusion coating method") including bringing a polymer extruded from an extrusion die into contact with base paper that has been conveyed at a nip point between a nip roller and a cooling roller, and pressure-bonding the polymer and the base paper with a nip to laminate the base paper with a polymer layer. In the formation of a polymer layer by the melt extrusion method, a pretreatment may be conducted so that the base paper and the polymer layer more firmly adhere to each other. Examples of the pretreatment include an acid etching treatment with a mixture of sulfuric acid and chromic acid, a flame treatment with a gas flame, an ultraviolet irradiation treatment, a corona discharge treatment, a glow discharge treatment, and an anchor coating treatment with an alkyl titanate or the like. Among these pretreatments, a corona discharge treatment is preferable.

<Method for Forming Ink-receiving Layer>

In the recording medium of the present invention, for example, the following methods can be employed as a method for forming an ink-receiving layer on a support. First, ink-receiving layer coating liquids are prepared, and the coating liquids are then applied onto a support and dried. Thus, a recording medium of the present invention can be obtained. In a method for applying the coating liquids, for example, a curtain coater, a coater using an extrusion system, or a coater using a slide hopper system can be used. The coating liquids may be heated during coating. Examples of the drying method after coating include methods using a hot-air dryer such as a linear tunnel dryer, an arch dryer, an air-loop dryer, or a sine-curve air float dryer; and methods using a dryer that uses infrared rays, a heating dryer, microwaves, or the like.

EXAMPLES

The present invention will now be described in more detail using Examples and Comparative Examples. The present invention is not limited by Examples described below as long as it does not exceed the gist of the present invention. Note that the term "part" in the description of Examples below is on a mass basis unless otherwise specified.

Preparation of Recording Medium

<Preparation of Support>

Eighty parts of LBKP having a freeness of 450 mL in terms of Canadian Standard Freeness (CSF), 20 parts of NBKP having a freeness of 480 mL in terms of Canadian Standard Freeness (CSF), 0.60 parts of cationized starch, 10 parts of heavy calcium carbonate, 15 parts of light calcium carbonate, 0.10 parts of an alkyl ketene dimer, and 0.030 parts of cationic polyacrylamide were mixed. Water was added to the resulting mixture such that the mixture had a solid content of 3.0% by mass, thereby preparing a paper material. Subsequently, the paper material was subjected to paper making with a Fourdrinier machine, in which three-stage wet pressing was performed, followed by drying with a multi-cylinder dryer. The resulting paper was then impregnated with an aqueous solution of oxidized starch using a size press device so as to have a solid content of 1.0 g/m$^2$ after drying, and then dried. Furthermore, the paper was subjected to machine calender finishing, thus preparing base paper having a basis weight of 170 g/m$^2$, a Stockigt sizing degree of 100 seconds, an air permeability of 50 seconds, a Bekk smoothness of 30 seconds, a Gurley stiffness of 11.0 mN, and a thickness of 100 μm. Next, a polymer composition containing 70 parts of low-density polyethylene, 20 parts of high-density polyethylene, and 10 parts of titanium oxide was applied onto a surface of the base paper such that the dry coating amount was 25 g/m$^2$. This surface is referred to as a "main surface" of a support. Furthermore, a polymer composition containing 50 parts of low-density polyethylene was applied onto another surface of the base paper such that the dry coating amount was 25 g/m$^2$. Thus, a support, both surfaces of which were coated with a polymer, was prepared.

<Preparation of Inorganic Particle Dispersion Liquid>

To 160.0 g of pure water, 40.0 g of a hydrated alumina DISPERAL HP14 (manufactured by Sasol) and 0.6 g (1.5% by mass relative to the solid content of the hydrated alumina) of methanesulfonic acid were added. The resulting mixture was then stirred with a mixer for 30 minutes. Thus, an inorganic particle dispersion liquid 1 (solid content: 20.0% by mass) containing the hydrated alumina as inorganic particles was prepared. The hydrated alumina in the inorganic particle dispersion liquid 1 had an average primary particle size of 130 nm.

<Preparation of Aqueous Solution of Binder>

An aqueous solution described below was prepared as an aqueous solution containing a water-soluble polymer having a hydroxyl group (solid content: 8.0% by mass).

Polymer aqueous solution A1: Aqueous solution of polyvinyl alcohol (PVA 235 (manufactured by Kuraray Co., Ltd.) having a degree of polymerization of 3,500 and a degree of saponification of 88% by mole)

Aqueous solutions described below were prepared as aqueous solutions each containing a water-soluble polymer not having a hydroxyl group (solid content of each solution: 8.0% by mass).

Polymer aqueous solution B1: Aqueous solution of polyvinylpyrrolidone (K-60 (manufactured by ISP Japan Ltd.) having a molecular weight of 400,000 and a glass transition temperature of 178° C.)

Polymer aqueous solution B2: Aqueous solution of polyacrylic acid (manufactured by Wako Pure Chemical Industries, Ltd. and having a molecular weight of 1,000,000 and a glass transition temperature of 120° C.)

Polymer aqueous solution B3: Aqueous solution of polyacrylamide (manufactured by Wako Pure Chemical Industries, Ltd. and having a molecular weight of 1,000,000 and a glass transition temperature of 180° C.)

Polymer aqueous solution B4: Aqueous solution of polyethylene oxide (manufactured by Wako Pure Chemical Industries, Ltd. and having a molecular weight of 1,000,000 and a glass transition temperature of 16° C.)<

<Preparation of Recording Medium>

A first coating liquid and a second coating liquid were simultaneously applied onto the support prepared above in that order with a curtain coater, and dried with hot air at 60° C. to 100° C., thus obtaining a recording medium. In this step, the film thicknesses (μm) were controlled to the values shown in Table 1. The first and second coating liquids used were each prepared by mixing the inorganic particle dispersion liquid prepared above (solid content: 20.0% by mass), the aqueous solution of a binder (solid content: 8.0% by mass), and an aqueous orthoboric acid solution (solid content: 5.0% by mass) functioning as a cross-linking agent so that the ratio of the solid content was the ratio shown in Table 1.

TABLE 1

Conditions for preparation of recording medium and layer thicknesses

| Recording medium No. | First ink-receiving layer: Conditions for preparation of first coating liquid (Ratio of solid content): Content of inorganic particle dispersion liquid (Part) | Water-soluble polymer having hydroxyl group Content of polymer aqueous solution A1 (Part) | Water-soluble polymer not having hydroxyl group: Type | Content (Part) | Content of boric acid (Part) | Thickness (μm) | Mass ratio of boric acid/water-soluble polymer having hydroxyl group (Time) | Mass ratio of water-soluble polymer not having hydroxyl group/water-soluble polymer having hydroxyl group (Time) | Second ink-receiving layer: Conditions for preparation of second coating liquid (Ratio of solid content): Content of inorganic particle dispersion liquid (Part) | Water-soluble polymer having hydroxyl group Content of polymer aqueous solution A1 (Part) | Water-soluble polymer not having hydroxyl group: Type | Content (Part) | Content of boric acid (Part) | Thickness (μm) | Mass ratio of boric acid/water-soluble polymer having hydroxyl group (Time) | Total thickness of ink-receiving layers (μm) |
|---|---|---|---|---|---|---|---|---|---|---|---|---|---|---|---|---|
| Recording medium 1 | 100 | 10 | B1 | 1 | 2 | 25 | 0.20 | 0.10 | 100 | 10 | — | 0 | 1 | 10 | 0.10 | 35 |
| Recording medium 2 | 100 | 10 | B1 | 2 | 2 | 25 | 0.20 | 0.20 | 100 | 10 | — | 0 | 1 | 10 | 0.10 | 35 |
| Recording medium 3 | 100 | 10 | B1 | 3 | 2 | 25 | 0.20 | 0.30 | 100 | 10 | — | 0 | 1 | 10 | 0.10 | 35 |
| Recording medium 4 | 100 | 10 | B1 | 5 | 2 | 25 | 0.20 | 0.50 | 100 | 10 | — | 0 | 1 | 10 | 0.10 | 35 |
| Recording medium 5 | 100 | 10 | B1 | 9 | 3 | 25 | 0.30 | 0.90 | 100 | 10 | — | 0 | 1 | 10 | 0.10 | 35 |
| Recording medium 6 | 100 | 8 | B1 | 7 | 4 | 25 | 0.50 | 0.88 | 100 | 10 | — | 0 | 1 | 10 | 0.10 | 35 |
| Recording medium 7 | 100 | 5 | B1 | 10 | 2 | 25 | 0.40 | 2.00 | 100 | 10 | — | 0 | 1 | 10 | 0.10 | 35 |
| Recording medium 8 | 100 | 5 | B1 | 15 | 2 | 25 | 0.40 | 3.00 | 100 | 10 | — | 0 | 1 | 10 | 0.10 | 35 |
| Recording medium 9 | 100 | 10 | B2 | 1 | 2 | 25 | 0.20 | 0.10 | 100 | 10 | — | 0 | 1 | 10 | 0.10 | 35 |
| Recording medium 10 | 100 | 10 | B2 | 3 | 2 | 25 | 0.20 | 0.30 | 100 | 10 | — | 0 | 1 | 10 | 0.10 | 35 |
| Recording medium 11 | 100 | 10 | B2 | 5 | 2 | 25 | 0.20 | 0.50 | 100 | 10 | — | 0 | 1 | 10 | 0.10 | 35 |
| Recording medium 12 | 100 | 5 | B2 | 10 | 2 | 25 | 0.40 | 2.00 | 100 | 10 | — | 0 | 1 | 10 | 0.10 | 35 |
| Recording medium 13 | 100 | 5 | B2 | 15 | 2 | 25 | 0.40 | 3.00 | 100 | 10 | — | 0 | 1 | 10 | 0.10 | 35 |
| Recording medium 14 | 100 | 10 | B4 | 1 | 2 | 25 | 0.20 | 0.10 | 100 | 10 | — | 0 | 1 | 10 | 0.10 | 35 |
| Recording medium 15 | 100 | 10 | B4 | 3 | 2 | 25 | 0.20 | 0.30 | 100 | 10 | — | 0 | 1 | 10 | 0.10 | 35 |

TABLE 1-continued

| Conditions for preparation of recording medium and layer thicknesses | | | | | | | | | | | | | | | | |
|---|---|---|---|---|---|---|---|---|---|---|---|---|---|---|---|---|
| | First ink-receiving layer | | | | | | | | Second ink-receiving layer | | | | | | | |
| | Conditions for preparation of first coating liquid (Ratio of solid content) | | | | | | | | Conditions for preparation of second coating liquid (Ratio of solid content) | | | | | | | |
| Recording medium No. | Content of inorganic particle dispersion liquid (Part) | Water-soluble polymer having hydroxyl group Content of polymer aqueous solution A1 (Part) | Water-soluble polymer not having hydroxyl group Type | Water-soluble polymer not having hydroxyl group Content (Part) | Content of boric acid (Part) | Thickness (μm) | Mass ratio of boric acid/water-soluble polymer having hydroxyl group (Time) | Mass ratio of water-soluble polymer not having hydroxyl group/water-soluble polymer having hydroxyl group (Time) | Content of inorganic particle dispersion liquid (Part) | Water-soluble polymer having hydroxyl group Content of polymer aqueous solution A1 (Part) | Water-soluble polymer not having hydroxyl group Type | Water-soluble polymer not having hydroxyl group Content (Part) | Content of boric acid (Part) | Thickness (μm) | Mass ratio of boric acid/water-soluble polymer having hydroxyl group (Time) | Total thickness of ink-receiving layers (μm) |
| Recording medium 16 | 100 | 10 | B4 | 5 | 2 | 25 | 0.20 | 0.50 | 100 | 10 | — | 0 | 1 | 10 | 0.10 | 35 |
| Recording medium 17 | 100 | 5 | B4 | 10 | 2 | 25 | 0.40 | 2.00 | 100 | 10 | — | 0 | 1 | 10 | 0.10 | 35 |
| Recording medium 18 | 100 | 5 | B4 | 15 | 2 | 25 | 0.40 | 3.00 | 100 | 10 | — | 0 | 1 | 10 | 0.10 | 35 |
| Recording medium 19 | 100 | 10 | B3 | 1 | 2 | 25 | 0.20 | 0.10 | 100 | 10 | — | 0 | 1 | 10 | 0.10 | 35 |
| Recording medium 20 | 100 | 10 | B3 | 3 | 2 | 25 | 0.20 | 0.30 | 100 | 10 | — | 0 | 1 | 10 | 0.10 | 35 |
| Recording medium 21 | 100 | 10 | B3 | 5 | 2 | 25 | 0.20 | 0.50 | 100 | 10 | — | 0 | 1 | 10 | 0.10 | 35 |
| Recording medium 22 | 100 | 5 | B3 | 10 | 2 | 25 | 0.40 | 2.00 | 100 | 10 | — | 0 | 1 | 10 | 0.10 | 35 |
| Recording medium 23 | 100 | 5 | B3 | 15 | 2 | 25 | 0.40 | 3.00 | 100 | 10 | — | 0 | 1 | 10 | 0.10 | 35 |
| Recording medium 24 | 100 | 10 | B1 | 5 | 2 | 25 | 0.20 | 0.50 | 100 | 10 | B1 | 1 | 1 | 10 | 0.10 | 35 |
| Recording medium 25 | 100 | 10 | — | 0 | 2 | 25 | 0.20 | 0 | 100 | 10 | B1 | 5 | 1 | 10 | 0.10 | 35 |
| Recording medium 26 | 100 | 10 | — | 0 | 2 | 25 | 0.20 | 0 | 100 | 10 | B2 | 5 | 1 | 10 | 0.10 | 35 |
| Recording medium 27 | 100 | 10 | — | 0 | 2 | 25 | 0.20 | 0 | 100 | 10 | B4 | 5 | 1 | 10 | 0.10 | 35 |
| Recording medium 28 | 100 | 10 | — | 0 | 2 | 25 | 0.20 | 0 | 100 | 10 | B3 | 5 | 1 | 10 | 0.10 | 35 |
| Recording medium 29 | 100 | 11 | — | 0 | 2 | 25 | 0.18 | 0 | 100 | 10 | — | 0 | 1 | 10 | 0.10 | 35 |
| Recording medium 30 | 100 | 10 | B1 | 3 | 2 | 25 | 0.20 | 0.30 | 100 | 10 | B1 | 5 | 1 | 10 | 0.10 | 35 |

[Evaluation]

In the present invention, A to C in the evaluation criteria of each of the evaluation items described below were considered to be a preferred level, and D and E in the evaluation criteria were considered to be an unacceptable level. When an image was recorded on a recording medium in each of the evaluations described below, the recording was conducted using an ink-jet recording apparatus PIXUS Pro9000 Mark II (manufactured by CANON KABUSHIKI KAISHA) including an ink cartridge BCI-7e (manufactured by CANON KABUSHIKI KAISHA) therein. Regarding the recording conditions, the recording was conducted at a temperature of 23° C. and a relative humidity of 50%. In the above ink-jet recording apparatus, an image recorded under the conditions that about 22 ng of an ink is provided in a unit region of 1/600 inch×1/600 inch at a resolution of 600 dpi×600 dpi is defined to have a recording duty of 100%.

(Evaluation of Optical Density of Image)

A black solid image having a recording duty of 100% was recorded on each of the recording media prepared above using the ink-jet recording apparatus. An optical density of the image was measured with a spectrophotometer Spectrolino (manufactured by Gretag Macbeth). The evaluation criteria are as follows. The evaluation results are shown in Table 2.

A: The optical density was 2.3 or more.

B: The optical density was 2.2 or more and less than 2.3.

C: The optical density was 2.1 or more and less than 2.2.

D: The optical density was 2.0 or more and less than 2.1.

E: The optical density was less than 2.0.

(Evaluation of Moisture Resistance of Image)

An image of a secondary color (blue) of cyan and magenta, the image including outline letters "A" (on which no ink was provided) with font sizes of 10 points and 48 points, was recorded on each of the recording media prepared above using the ink-jet recording apparatus. In this recording, the recording duty of cyan was set to 100% and the recording duty of magenta was set to 100%. The obtained image was stored under a high-humidity condition at a relative humidity of 90% and at a temperature of 30° C. for 25 days. Moisture resistance of the image was evaluated by visually observing the outline portion of the image. The evaluation criteria are as follows. The evaluation results are shown in Table 2.

A: In each of the letter of 10 points and the letter of 48 points, no bleeding of the color into the outline letter portion was observed.

B: In the letter of 48 points, no bleeding of the color into the outline letter portion was observed. In the letter of 10 points, bleeding of the color into the outline letter portion was slightly observed but the bleeding was at an unconscious level.

C: In each of the letter of 10 points and the letter of 48 points, bleeding of the color into the outline letter portion was slightly observed but the bleeding was at an unconscious level.

D: In the letter of 48 points, bleeding of the color into the outline letter portion was slightly observed. In the letter of 10 points, bleeding of the color into the outline letter portion was observed and a part of the letter was illegible.

E: In each of the letter of 10 points and the letter of 48 points, bleeding of the color into the outline letter portion was significantly observed and a part of the letter was illegible.

(Evaluation of Ink-Absorbing Property)

Five green solid images having recording duties of 150%, 200%, 250%, 300%, and 350% were recorded on recording media using the ink-jet recording apparatus. In this recording, the recording duty of cyan and the recording duty of yellow were set to be the same so that the total of these recording duties was set to the above recording duties. For example, in the green solid image having a recording duty of 350%, the recording duty of cyan was set to 175% and the recording duty of yellow was 175%. An ink-absorbing property was evaluated by visually observing the occurrence or non-occurrence of a beading phenomenon in the images. The term "beading phenomenon" refers to a phenomenon in which ink droplets before being absorbed in a recording medium are combined with each other. It is known that the beading phenomenon is highly correlated with the ink-absorbing property. When the beading phenomenon does not occur even in an image having a high recording duty, it is determined that the ink-absorbing property is high. The evaluation criteria are as follows. The evaluation results are shown in Table 2.

A: The beading phenomenon did not occur even in the image having a recording duty of 350%.

B: The beading phenomenon occurred in the image having a recording duty of 350% but did not occur in the image having a recording duty of 300%.

C: The beading phenomenon occurred in the image having a recording duty of 300% but did not occur in the image having a recording duty of 250%.

D: The beading phenomenon occurred in the image having a recording duty of 250% but did not occur in the image having a recording duty of 200%.

E: The beading phenomenon occurred even in the image having a recording duty of 200%.

(Evaluation of Conveyance Scratch Resistance)

The above ink-jet recording apparatus was modified so that the pressure of a conveying roller could be adjusted to 1.7 to 2.2 kgf. A black solid image (having a recording duty of 100%) was recorded over the entire surface of a recording medium using the ink-jet recording apparatus. Conveyance scratch resistance of the recording medium was evaluated by visually observing the presence or absence of a conveyance scratch formed by the conveying roller and on the recording medium after recording. The evaluation criteria are as follows. The evaluation results are shown in Table 2.

A: No conveyance scratch was observed even when the pressure of the conveying roller was 2.2 kgf.

B: No conveyance scratch was observed when the pressure of the conveying roller was 2.0 kgf. However, a conveyance scratch was observed when the pressure of the conveying roller was 2.2 kgf.

C: No conveyance scratch was observed when the pressure of the conveying roller was 1.8 kgf. However, a conveyance scratch was observed when the pressure of the conveying roller was 2.0 kgf.

D: No conveyance scratch was observed when the pressure of the conveying roller was 1.7 kgf. However, a conveyance scratch was observed when the pressure of the conveying roller was 1.8 kgf.

E: A conveyance scratch was observed even when the pressure of the conveying roller was 1.7 kgf.

TABLE 2

| Evaluation results | | | | | |
|---|---|---|---|---|---|
| Example No. | Recording medium No. | Optical density of image | Moisture resistance of image | Ink-absorbing property | Conveyance scratch resistance |
| Example 1 | Recording medium 1 | A | B | A | B |
| Example 2 | Recording medium 2 | A | A | A | A |

TABLE 2-continued

| Evaluation results | | | | | |
|---|---|---|---|---|---|
| Example No. | Recording medium No. | Optical density of image | Moisture resistance of image | Ink-absorbing property | Con-veyance scratch resistance |
| Example 3 | Recording medium 3 | A | A | A | A |
| Example 4 | Recording medium 4 | A | A | A | A |
| Example 5 | Recording medium 5 | A | A | C | A |
| Example 6 | Recording medium 6 | A | A | A | A |
| Example 7 | Recording medium 7 | A | A | A | A |
| Example 8 | Recording medium 8 | A | A | C | A |
| Example 9 | Recording medium 9 | A | C | B | B |
| Example 10 | Recording medium 10 | A | B | B | B |
| Example 11 | Recording medium 11 | A | B | B | A |
| Example 12 | Recording medium 12 | A | B | B | B |
| Example 13 | Recording medium 13 | A | C | C | A |
| Example 14 | Recording medium 14 | A | B | B | B |
| Example 15 | Recording medium 15 | A | A | B | A |
| Example 16 | Recording medium 16 | A | A | A | A |
| Example 17 | Recording medium 17 | A | A | A | A |
| Example 18 | Recording medium 18 | A | A | C | A |
| Example 19 | Recording medium 19 | A | C | B | C |
| Example 20 | Recording medium 20 | A | B | B | B |
| Example 21 | Recording medium 21 | A | B | B | A |
| Example 22 | Recording medium 22 | A | B | B | A |
| Example 23 | Recording medium 23 | A | A | C | A |
| Example 24 | Recording medium 24 | C | C | B | A |
| Comparative Example 1 | Recording medium 25 | D | D | E | B |
| Comparative Example 2 | Recording medium 26 | D | E | E | C |
| Comparative Example 3 | Recording medium 27 | D | D | E | B |
| Comparative Example 4 | Recording medium 28 | D | D | E | D |
| Comparative Example 5 | Recording medium 29 | D | C | C | E |
| Comparative Example 6 | Recording medium 30 | B | E | E | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-226148 filed Oct. 11, 2012, which is hereby incorporated by reference herein in its entirety.

What is claimed is:

1. A recording medium comprising:

a support;

a first ink-receiving layer; and a second ink-receiving layer in that order, wherein the first ink-receiving layer includes an inorganic particle, a water-soluble polymer having a hydroxyl group, a water-soluble polymer not having a hydroxyl group, and a boric acid compound, and the second ink-receiving layer includes an inorganic particle, a water-soluble polymer having a hydroxyl group, and a boric acid compound, and satisfies a condition (1) or (2) below:

Condition (1): The second ink-receiving layer does not include the water-soluble polymer not having the hydroxyl group.

Condition (2): The second ink-receiving layer includes the water-soluble polymer not having the hydroxyl group, but the content of the water-soluble polymer not having the hydroxyl group relative to the content of the inorganic particle in the second ink-receiving layer is smaller than the content of the water-soluble polymer not having the hydroxyl group relative to the content of the inorganic particle in the first ink-receiving layer.

2. The recording medium according to claim 1, wherein, in the first ink-receiving layer, a mass ratio of the content of the water-soluble polymer having the hydroxyl group to the content of the inorganic particle is 5.0% by mass or more and 17.0% by mass or less.

3. The recording medium according to claim 1, wherein, in the first ink-receiving layer, a mass ratio of the content of the water-soluble polymer not having the hydroxyl group to the content of the inorganic particle is 1.0% by mass or more and 15.0% by mass or less.

4. The recording medium according to claim 1, wherein, in the first ink-receiving layer, the content (% by mass) of the water-soluble polymer not having the hydroxyl group is 0.1 times or more and 3.0 times or less the content (% by mass) of the water-soluble polymer having the hydroxyl group in terms of mass ratio.

5. The recording medium according to claim 1, wherein the water-soluble polymer having the hydroxyl group is at least one selected from polyvinyl alcohol and polyvinyl alcohol derivatives.

6. The recording medium according to claim 1, wherein the water-soluble polymer not having the hydroxyl group is at least one selected from polyvinylpyrrolidone, polyacrylic acid, polymethacrylic acid, polyethylene oxide, and polyacrylamide.

7. The recording medium according to claim 1, wherein the water-soluble polymer having the hydroxyl group has a hydroxyl value of 500 mgKOH/g or more, and the water-soluble polymer not having the hydroxyl group has a hydroxyl value of 50 mgKOH/g or less.

8. The recording medium according to claim 1, wherein the inorganic particle includes at least one selected from hydrated alumina, alumina, and silica.

* * * * *